US007372432B2

(12) United States Patent
Lee

(10) Patent No.: US 7,372,432 B2
(45) Date of Patent: May 13, 2008

(54) SWITCHING DEVICE AND DRIVING APPARATUS FOR PLASMA DISPLAY PANEL

(75) Inventor: Dong-Young Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 663 days.

(21) Appl. No.: 10/964,924

(22) Filed: Oct. 15, 2004

(65) Prior Publication Data

US 2005/0093782 A1 May 5, 2005

(30) Foreign Application Priority Data

Oct. 16, 2003 (KR) ..... 10-2003-0072314

(51) Int. Cl.
*G09G 3/10* (2006.01)
*G09G 3/28* (2006.01)

(52) U.S. Cl. ..... 345/60; 345/62; 315/169.4

(58) Field of Classification Search ..... 345/60–83, 345/204–214; 315/169.1–169.4
See application file for complete search history.

(56) References Cited

U.S. PATENT DOCUMENTS

| | | | | |
|---|---|---|---|---|
| 6,028,573 | A * | 2/2000 | Orita et al. | 345/66 |
| 2005/0162347 | A1 * | 7/2005 | Jin | 345/60 |

FOREIGN PATENT DOCUMENTS

| | | |
|---|---|---|
| CN | 1551067 | 12/2004 |
| JP | 5-090933 | 4/1993 |
| JP | 7-046822 | 2/1995 |
| JP | 7-302898 | 11/1995 |
| JP | 8-274428 | 10/1996 |
| JP | 9-130217 | 5/1997 |
| JP | 10-080152 | 3/1998 |
| JP | 2000-330514 | 11/2000 |
| JP | 2000-350475 | 12/2000 |
| JP | 2002-016253 | 1/2002 |
| JP | 2002-016486 | 1/2002 |
| JP | 2002-017080 | 1/2002 |
| JP | 2002-369498 | 12/2002 |
| JP | 2003-228318 | 8/2003 |
| KR | 10-2003-0077936 A | 10/2003 |

* cited by examiner

*Primary Examiner*—David L. Lewis
(74) *Attorney, Agent, or Firm*—H.C. Park & Associates, PLC

(57) ABSTRACT

A switching device for a plasma display panel that facilitates operations at a high voltage. The switching device may be formed with more than one insulated gate bipolar transistors (IGBT) coupled in parallel. The switching device may also be formed with an insulated gate bipolar transistor and a metal-oxide semiconductor field effect transistor (MOSFET) coupled in parallel. The MOSFET may be used for the switching device in a low current area and the IGBT may be used for the switching device in a high current area.

16 Claims, 9 Drawing Sheets

SWITCHING DEVICE AND DRIVING APPARATUS FOR PLASMA DISPLAY PANEL

CROSS REFERENCE TO RELATED APPLICATION

This application claims priority to and the benefit of Korean Patent Application No. 10-2003-0072314, filed on Oct. 16, 2003, which is hereby incorporated by reference for all purposes as if fully set forth herein.

BACKGROUND OF THE INVENTION

1. Field of the Invention

The present invention relates to a switching device for a plasma display panel (PDP). More specifically, the present invention relates to a PDP switching device that facilitates operation at a high voltage.

2. Discussion of the Related Art

Various flat panel displays such as the liquid crystal display (LCD), the field emission display (FED), and PDP have been developed. Of these, the PDP has higher resolution, a higher rate of emission efficiency, and a wider view angle. Accordingly, the PDP is in the spotlight as a substitute display for the conventional cathode ray tube (CRT), especially in the large-sized displays of greater than forty inches.

The PDP shows characters or images using plasma generated by gas discharge, and it may include more than hundreds of thousands to millions of pixels arranged in a matrix. The PDP is divided into a direct current (DC) PDP and an alternating current (AC) PDP according to an applied driving voltage waveform and discharge cell structure.

FIG. 1 shows a partial perspective view of an AC PDP.

As shown in FIG. 1, scan electrodes 4 and sustain electrodes 5 are formed in parallel pairs on a first glass substrate 1, and they are covered with a dielectric layer 2 and a protection film 3. A plurality of address electrodes 8 is formed on a second glass substrate 6, and the address electrodes 8 are covered with an insulator layer 7. Barrier ribs 9 are formed between and in parallel with the address electrodes 8 on the insulator layer 7, and phosphors 10 are formed on the surface of the insulator layer 7 and on both sides of the barrier ribs 9. The first and second glass substrates 1 and 6 are sealed together to form a discharge spaces 11 therebetween so that the scan electrodes 4 and the sustain electrodes 5 are orthogonal to the address electrodes 8. A portion of the discharge space 11 at an intersection of an address electrode 8 and a pair of the scan electrode 4 and the sustain electrode 5 forms a discharge cell 12.

FIG. 2 schematically shows a typical electrode arrangement of the AC PDP.

As shown in FIG. 2, the electrodes comprise an m x n matrix. The address electrodes $A_1$ to $A_m$ are arranged in the column direction and the scan electrodes $Y_1$ to $Y_n$ and the sustain electrodes $X_1$ to $X_n$ are alternately arranged in the row direction. The discharge cell 12 corresponds to the discharge cell 12 in FIG. 1.

A conventional method for driving the AC PDP comprises a reset period, an address period, and a sustain period.

In the reset period, cells are initialized for proper addressing. In the address period, an address voltage is applied to cells (addressed cells) that are to be turned on, which accumulates wall charges in those addressed cells. In the sustain period, sustain discharges occur in the addressed cells to display images on the PDP.

With this method, a desired voltage may be applied by a plurality of switching devices in the reset, address, and sustain periods. But due to an applied pulse-type voltage, a narrow, pulse-type current may flow rapidly through the switching device in the address period and the sustain period. A Metal-Oxide Semiconductor Field Effect Transistor (MOSFET), which has a fast switching speed, is usually used for a switching device. However, the resistance $R_{on}$ between the MOSFET's drain and source when it is turned on may increase sharply when a withstand voltage of the MOSFET increases. Therefore, as the pulse type of current flows, a value of a Root-Mean-Square (RMS) may be very high for the MOSFET. Accordingly, a MOSFET may have a high conduction loss and it may generate a lot of heat.

A method for switching by using a plurality of MOSFETs M1 and M2 coupled in parallel, as shown in FIG. 3, may be used for solving this problem. However, it may be advantageous to increase a partial pressure of Xe gas input into the PDP, which requires more MOSFETs coupled in parallel since a higher driving voltage is necessary due to the increased partial pressure. But increasing the number of MOSFETs may increase cost, the size of a driving board, and the number of driving circuits.

SUMMARY OF THE INVENTION

It is an advantage of the present invention to provide a switching device for a plasma display panel for reducing cost and increasing efficiency.

Additional features of the invention will be set forth in the description which follows, and in part will be apparent from the description, or may be learned by practice of the invention.

The present invention discloses a switching device for driving a plasma display panel having a plurality of address electrodes, a plurality of scan electrodes and a plurality of sustain electrodes arranged in pairs, and panel capacitors positioned between the plurality of address electrodes, and between the plurality of scan electrodes and the plurality of sustain electrodes. The switching device comprises a first insulated gate bipolar transistor for performing turning on or turning off operations by a voltage applied to a gate of the first insulated gate bipolar transistor, and a second insulated gate bipolar transistor, coupled in parallel to the first insulated gate bipolar transistor, for performing the turning on or turning off operations by a voltage applied to a gate of the second insulated gate bipolar transistor.

The present invention also discloses a switching device for driving a plasma display panel having a plurality of address electrodes, and a plurality of scan electrodes and a plurality of sustain electrodes arranged in pairs, and panel capacitors formed between the plurality of address electrodes, and between the plurality of scan electrodes and the plurality of sustain electrodes. The switching device comprises a first metal-oxide semiconductor field effect transistor for performing turning on or turning off operations by a voltage applied to a gate of the first metal-oxide semiconductor field effect transistor, and a first insulated gate bipolar transistor, coupled in parallel to the first metal-oxide semiconductor field effect transistor, for performing the turning on or turning off operations by a voltage applied to a gate of the first insulated gate bipolar transistor.

The present invention also discloses an apparatus for driving a plasma display panel in which a discharge space is formed by a plurality of first electrodes and a plurality of second electrodes, comprising a first switch coupled between the plurality of first electrodes and a first power supplying a first voltage, and a second switch coupled between the plurality of first electrodes and a second power supplying a second voltage. The first switch and the second switch comprise at least two insulated gate bipolar transistors coupled in parallel. The first voltage applies a sustain voltage, which is a voltage difference between the first voltage and the second voltage, in the sustain period.

The present invention also discloses an apparatus for driving a plasma display panel in which a discharge space is formed by a plurality of first electrodes and a plurality of second electrodes, comprising a first switch coupled between the plurality of first electrodes and a first power supplying a first voltage, and a second switch coupled between the plurality of first electrodes and a second power supplying a second voltage. The first switch and the second switch comprise a metal-oxide semiconductor field effect transistor and an insulated gate bipolar transistor coupled in parallel. The first voltage applies a sustain voltage, which is a voltage difference between the first voltage and the second voltage, in the sustain period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
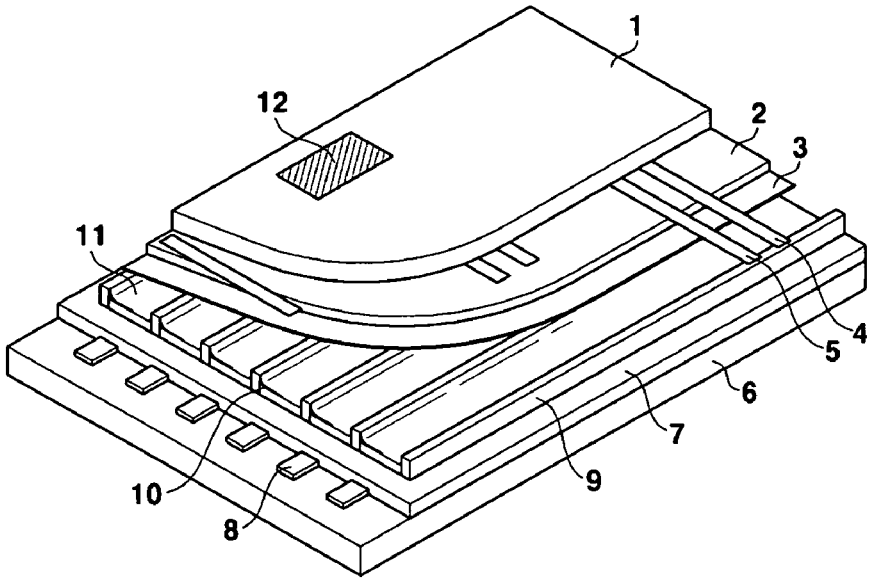
FIG. 1 shows a partial perspective view of an AC PDP.
Figure 2:
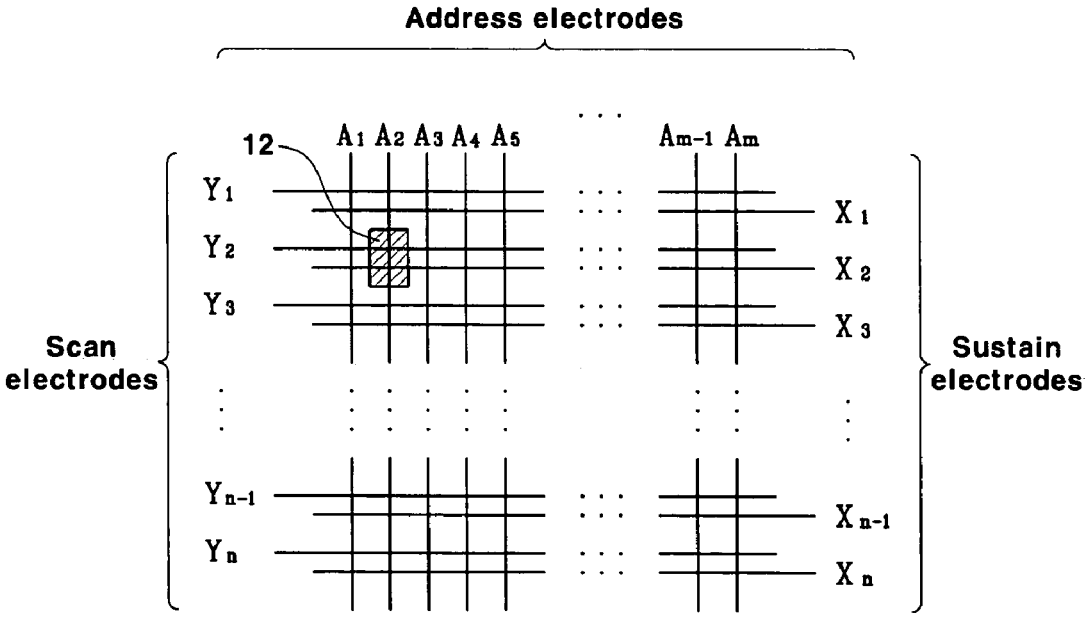
FIG. 2 shows a typical electrode arrangement of an AC PDP.
Figure 3:
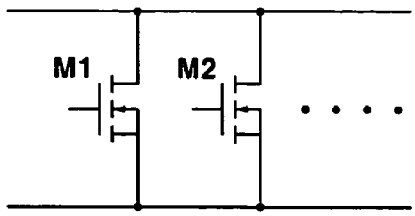
FIG. 3 is a diagram for representing a conventional switching device for a PDP.

The following detailed description shows and describes preferred embodiments of the invention simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

Figure 4:
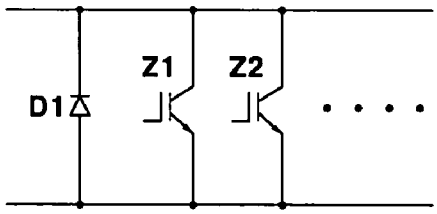
FIG. 4 is a diagram for representing a switching device for a PDP according to a first exemplary embodiment of the present invention.

FIG. 4 is a diagram for representing a switching device for a PDP according to a first exemplary embodiment of the present invention.

As shown in FIG. 4, the switching device for the PDP according to the first exemplary embodiment of the present invention comprises insulated gate bipolar transistors (IGBT) Z1 and Z2 and a diode D1. IGBT Z1, IGBT Z2 and diode D1 are coupled in parallel. The diode D1 is coupled in parallel to the IGBTs Z1 and Z2 to allow a reverse current to flow because the IGBTs Z1 and Z2 do not have a body diode.

The IGBTs Z1 and Z2 apply a voltage to the PDP during driving operations. A plurality of the IGBTs may be coupled in parallel when a driving current is great and current capacity is increased. IGBTs Z1 and Z2 are provided in a driving circuit of the PDP and perform switching operations to operate a reset period, an address period, and a sustain period.

Figure 5:
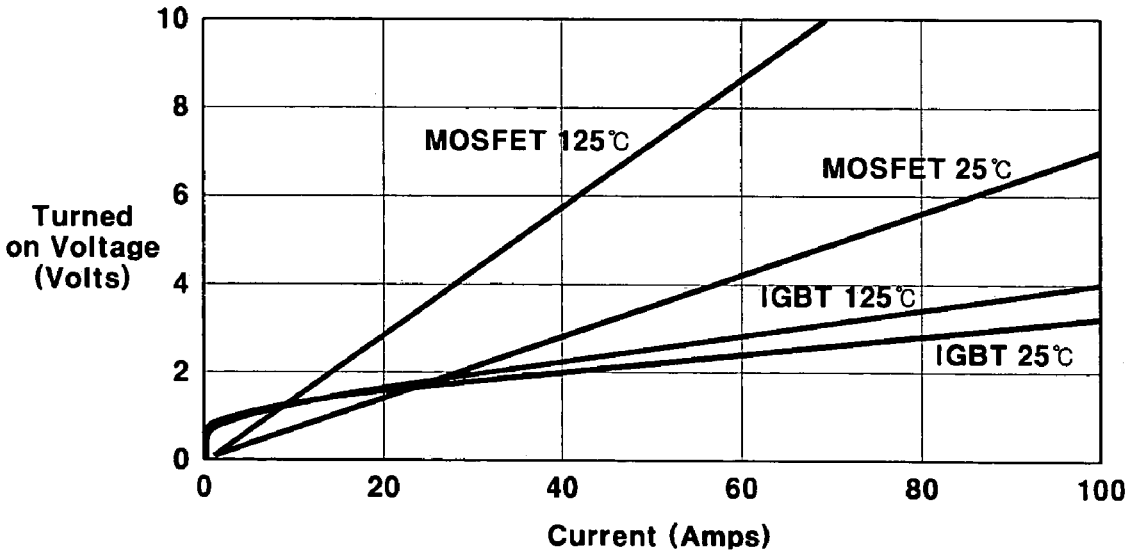
FIG. 5 is a graph of MOSFET and insulated gate bipolar transistor (IGBT) current and voltage characteristics.

FIG. 5 is a graph for representing characteristics of currents and voltages at temperatures of 25° C. and 125° C. when a MOSFET and an IGBT are turned on. As shown in FIG. 5, the IGBT outperforms the MOSFET in the high current area. In other words, when the same current flows in the high current area, a voltage at the IGBT is less than the voltage at the MOSFET. Comparing currents and voltages when the MOSFET has a temperature of 25° C. and the IGBT has a temperature of 125° C., the IGBT at 125° C. has greater characteristics. Therefore, the temperature characteristic of the IGBT is greater than that of the MOSFET. Accordingly, the voltage loss of the IGBT is less than that of MOSFET because the voltage at the IGBT is less than the voltage at the MOSFET when the same current is applied.

When the IGBT is turned on, it is diode-connected (the IGBT is a bipolar transistor that becomes a diode-connection when it is turned on). Therefore, a diode voltage of $V_{ce}$, which is a voltage between a collector and an emitter, is applied to the IGBT. The diode voltage of $V_{ce}$ does not increase when current increases. Consequently, a conduction loss of the IGBT may be much less than that of the MOSFET when a pulse discharge current, generated by a PDP discharge, flows. As described above, since the MOSFET is equivalent to $R_{on}$ when it is turned on, its conduction loss may increase with higher pulse currents. Because of its structure, at the same withstand voltage, the IGBT has better current conduction performance per unit area than the MOSFET. Hence, a size of a semiconductor chip and a cost of the switching device may be reduced.

In the PDP, a high and narrow pulse type current may flow and reach zero when a discharge firing operation is performed by turning on the switching device. Then, the switching device is turned off. Accordingly, the PDP may be driven at high speed because the IGBT, which does not turn off quickly, performs the turning off operation when the current reaches zero. In the words, the IGBT's weak turning off quality is not problematic in driving the PDP.

Figure 6A:
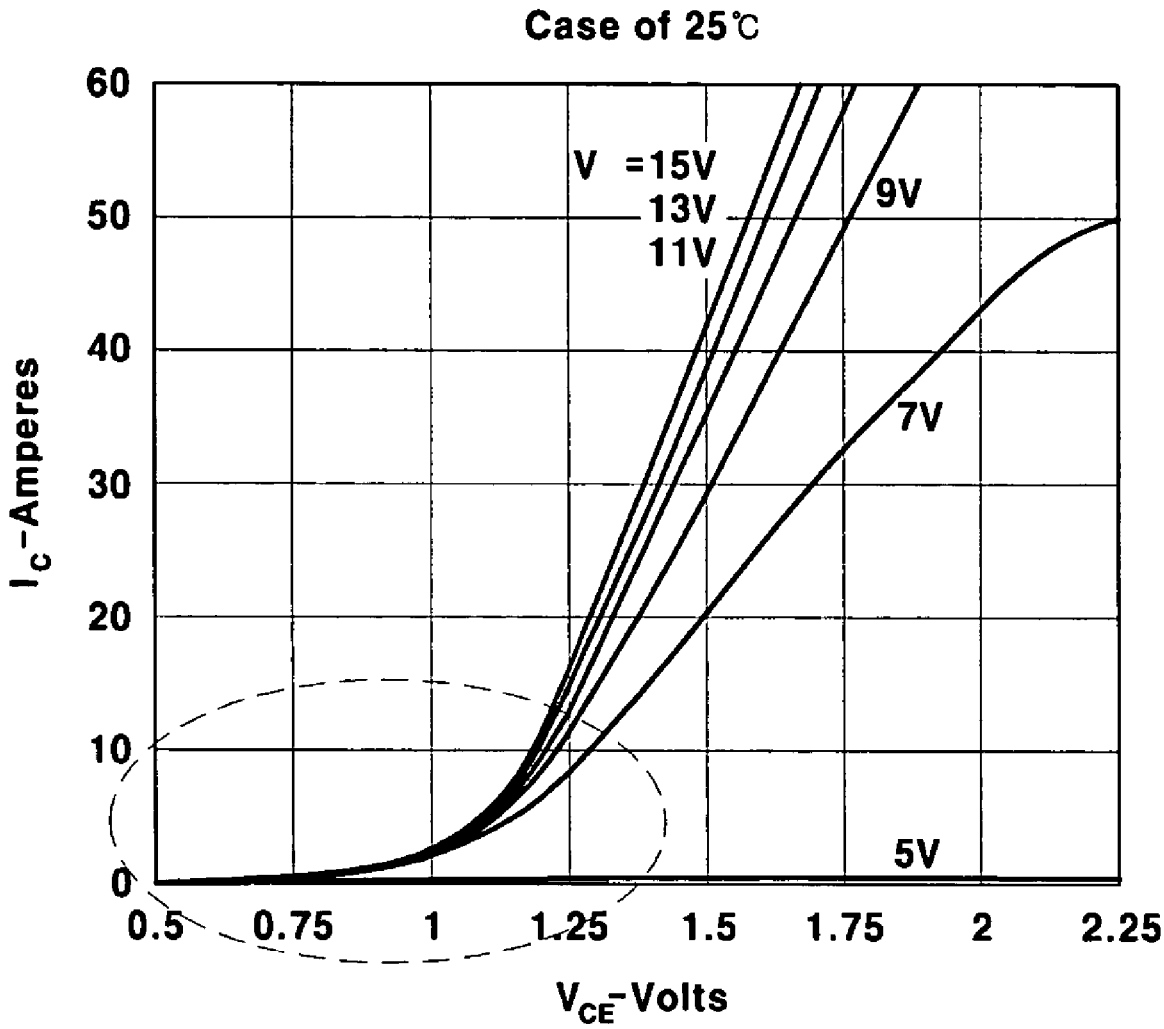
FIG. 6A and FIG. 6B are graphs for representing a relation between a Vce voltage and an Ic current of an IGBT.
Figure 6B:
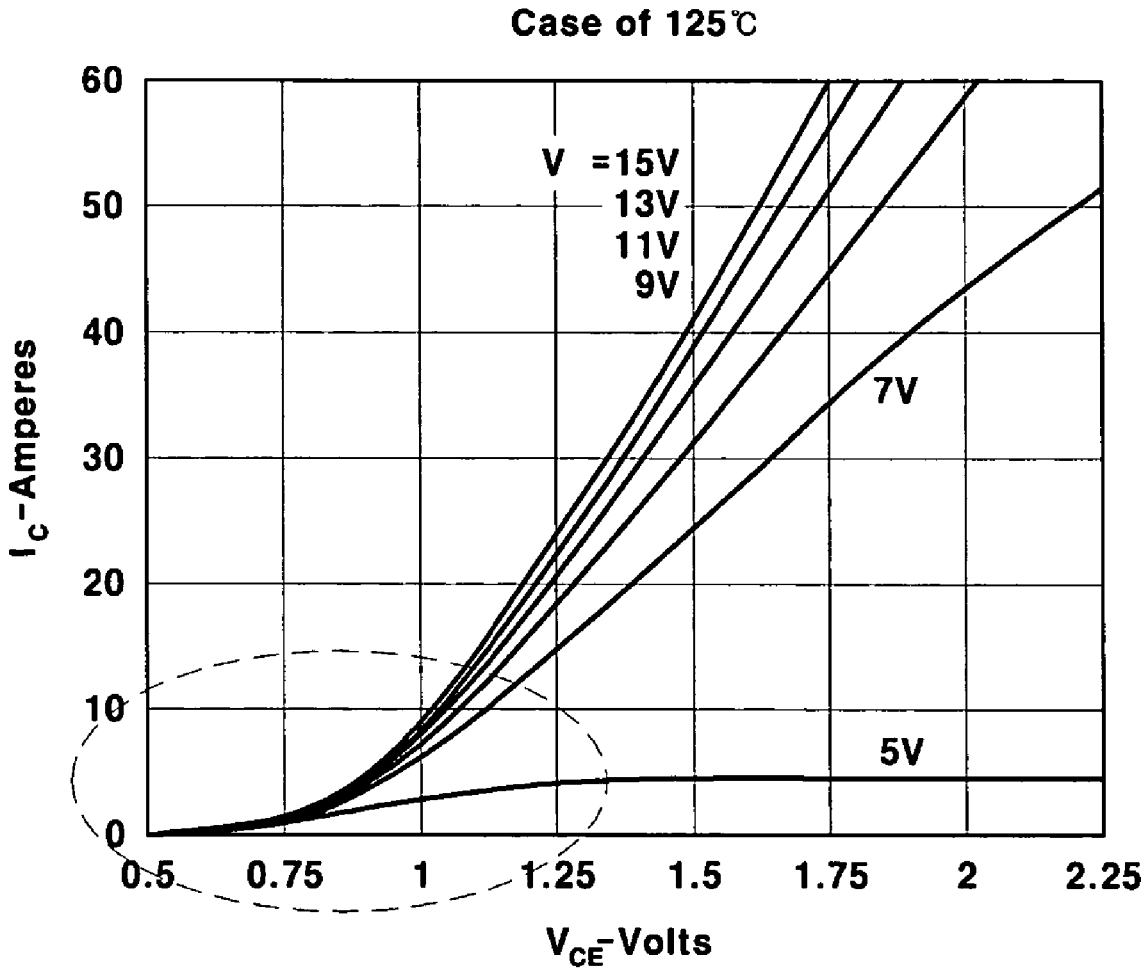

However, when the IGBTs are coupled in parallel and used for the switching device according to the first exemplary embodiment of the present invention, the voltage of $V_{ce}$ may have a positive temperature coefficient when the IGBT is turned on, and a load current may be concentrated on one side. FIG. 6A and FIG. 6B are graphs for representing a relation between the $V_{ce}$ voltage and an $I_c$ current of an IGBT at temperatures of 25° C. and 125° C. The voltages of 15V, 13V, 11v, 9V, 7V, and 5V shown in FIGS. 6A and 6B respectively represent the gate-emitter voltages. The voltage of $V_{ce}$ represents the voltage between the collector and the emitter when the IGBT is turned on, and the $I_c$ current represents a collector current when the IGBT is turned on. As shown in the circled areas of FIG. 6A and FIG. 6B, a higher current of $I_c$ flows at the higher temperatures in FIG. 6B when the same condition of voltage of $V_{ce}$ is provided. Accordingly, as the IGBT's temperature increases, a higher current flows to the IGBT Z1, which problematically concentrates the load current at one IGBT and generates heat. Therefore, when the switching device is formed with the parallel IGBTs as shown in FIG. 4, its efficiency gained at the high current area is reduced because a voltage drop is greater than that of the MOSFET in the early period of turning on the switch and in the period of decreased current flow.

The following describes a switching device for the PDP that may solve this problem of the first exemplary embodiment of the present invention.

Figure 7:
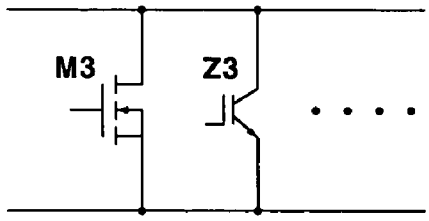
FIG. 7 is a diagram for representing a switching device for a PDP according to a second exemplary embodiment of the present invention.

FIG. 7 is a diagram for representing a switching device for a PDP according to a second exemplary embodiment of the present invention.

As shown in FIG. 7, the switching device for the PDP according to the second exemplary embodiment of the present invention comprises a MOSFET M3 coupled in parallel with an IGBT Z3. More than one MOSFET and more than one IGBT may be used for the switching device for a large PDP requiring a high current capacity.

The MOSFET M3 may be used for the switching device in a low current area, and the IGBT Z3 may be used for the switching device in a high current area. The IGBT Z3 may be used for the switching device in the high current area because it may have a high voltage drop in the low current area, as shown in FIG. 5, which reduces efficiency. The MOSFET M3 may be used for the switching device in the low current area because it is equivalent to $R_{on}$ and may not generate a high voltage drop, which results in higher efficiency than the IGBT.

Figure 8A:
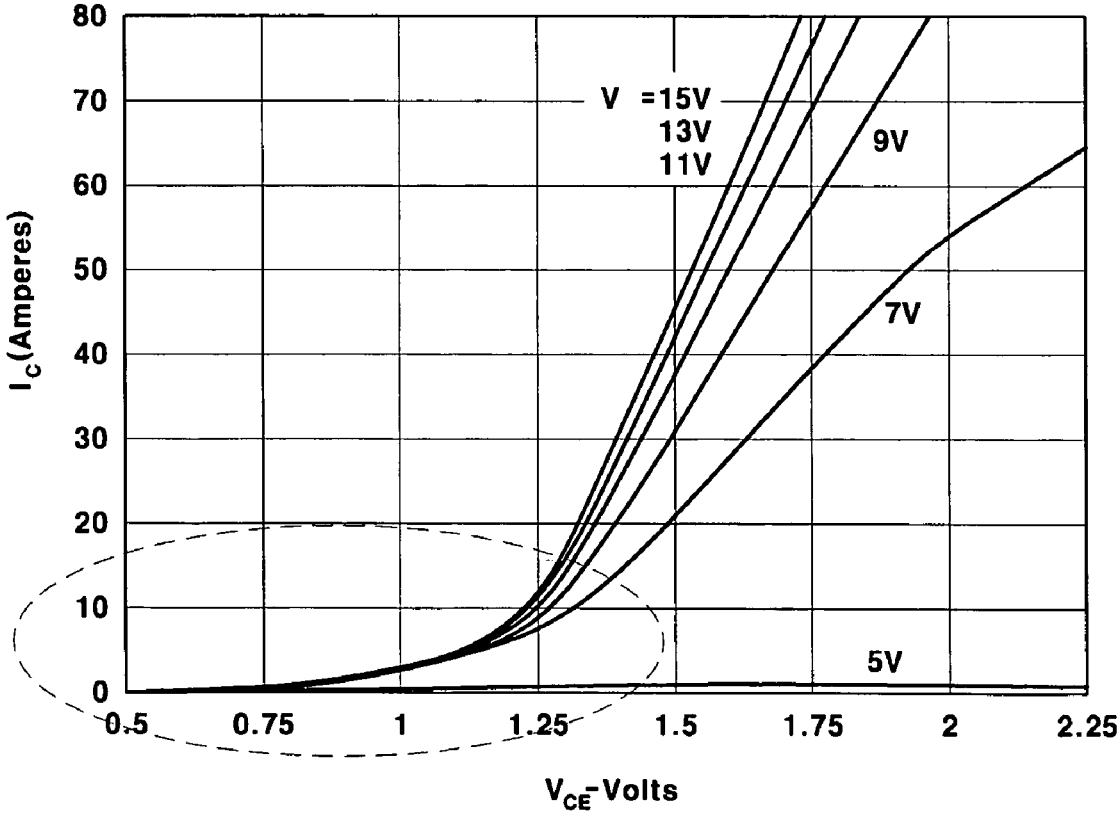
FIG. 8A is a graph for representing a relation between a Vce voltage and Ic current for an IGBT.
Figure 8B:
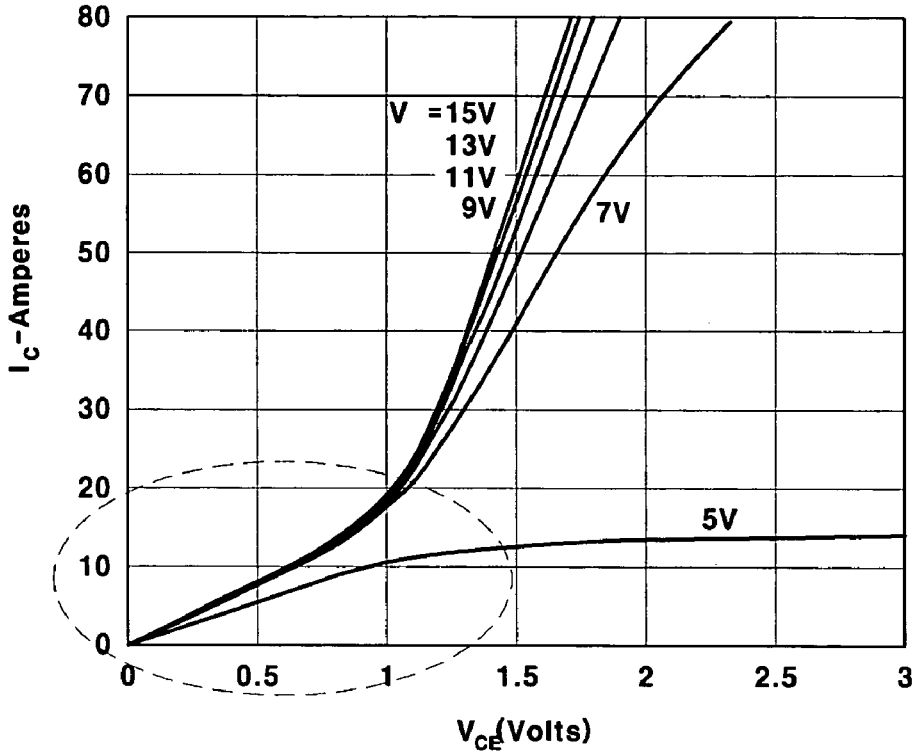
FIG. 8B is a graph for representing a relation between the Vce voltage and the Ic current when a MOSFET and the IGBT are coupled in parallel.

FIG. 8A is a graph for representing a relation between the voltage Of $V_{ce}$ and the current of $I_c$ when the IGBT Z3 is turned on and used for the switching device. FIG. 8B is a graph for representing a relation between the voltage of $V_{ce}$ and the current of $I_c$ when the MOSFET M3 and the IGBT Z3 coupled in parallel are turned on and used for the switching device. The voltages of 15V, 13V, 11V, 9V, 7V, and 5V shown in FIGS. 8A and 8B respectively represent the gate-emitter voltages. As circled in FIG. 8A, a voltage drop of the IGBT may be high in the low current area. However, as circled in FIG. 8B, when the MOSFET M3 and the IGBT Z3 are coupled in parallel, a proportional relation between the $I_c$ current and the $V_{ce}$ voltage may exist, and the MOSFET M3 operates in the low current area, which may provide a lower voltage drop for the same current $I_c$ condition. In other words, when the MOSFET M3 operates in the low current area, the proportional relation is given and the voltage drop is decreased, as circled in FIG. 8B, because the MOSFET is equivalent to the $R_{on}$ when it is turned on. Accordingly, the efficiency of the switching device may increase. As shown in FIG. 8B, the IGBT Z3 may operate in the high current area (outside of the circled area). The voltage is maintained at a constant value when the current is increased, because the voltage of the IGBT Z3 becomes $V_{ce}$ when it is turned on. The efficiency of the switching device may be further improved because the IGBT Z3 operates in the high current area, and the voltage of the IGBT Z3 becomes the voltage of $V_{ce}$ when a pulse discharge current flows. Consequently, using the MOSFET M3 in the low current area and the IGBT Z3 in the high current area may increase the switching device's efficiency.

Diode D1 to be coupled in parallel to the IGBT may not be needed. When the IGBT Z3 is coupled in parallel with the MOSFET M3, the diode D1 may not be necessary because the MOSFET M3 includes a body diode and it conducts the reverse current when the MOSFET M3 and the IGBT Z3 are used for the switching device.

Figure 9:
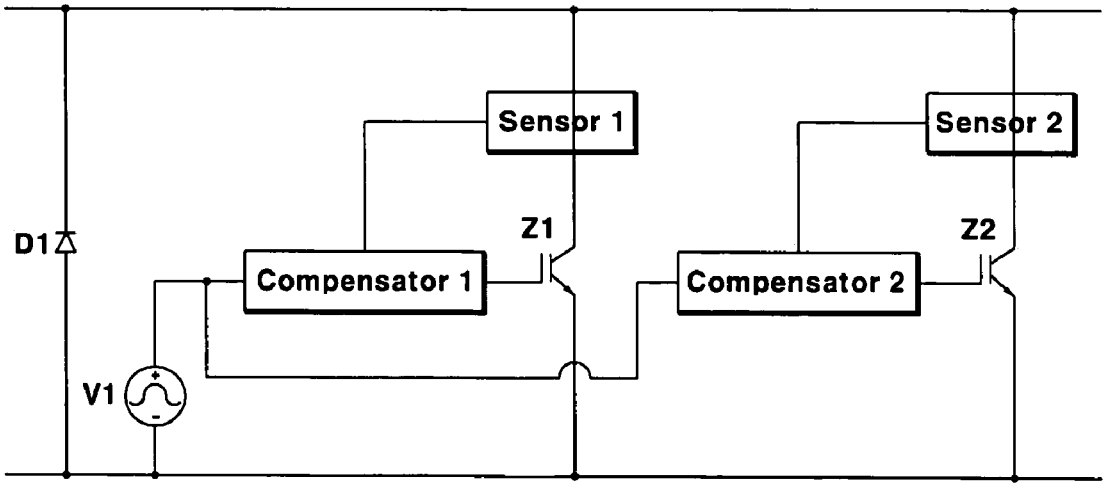
FIG. 9 is a diagram for representing a switching device for a PDP according to a third exemplary embodiment of the present invention.

FIG. 9 is a diagram for representing a switching device for the PDP according to a third exemplary embodiment of the present invention. The switching device shown in FIG. 9 may solve a problem of the switching device according to the first exemplary embodiment of the present invention, in which the load current is concentrated to one side of the device because of the positive temperature coefficient characteristic.

As shown in FIG. 9, the collector of the IGBT Z1 and the collector of the IGBT Z2 are coupled to a sensor 1 and a sensor 2, respectively, and a gate of the IGBT Z1 and a gate of the IGBT Z2 are coupled to a compensator 1 and a compensator 2, respectively. The sensor 1 and the sensor 2 measure the current when the switching device is turned on, and the compensator 1 and the compensator 2 compensate a gate voltage applied to the switching device. A power of V1 represents a power applied to the gates of the IGBTs Z1 and Z2 for turning them on and off.

The sensors 1 and 2 measure the current flowing through the collectors of the IGBTs Z1 and Z2 and transmit the measured value of the load current to the compensators 1 and 2. The compensators 1 and 2 use the load current transmitted by the sensors 1 and 2 to compensate gate driving voltages of the IGBT Z1 and the IGBT Z2, thereby establishing equal load currents through the IGBTs Z1 and Z2 and solving the problem of the load current being concentrated on one side. When additional current flows through the IGBT Z1, the compensator 1 reduces that current by reducing the voltage applied to the gate of the IGBT Z1. The compensator 1 and the compensator 2 may adjust the voltage of the gate power V1 by using a transformer or a signal amplifier.

Figure 10:
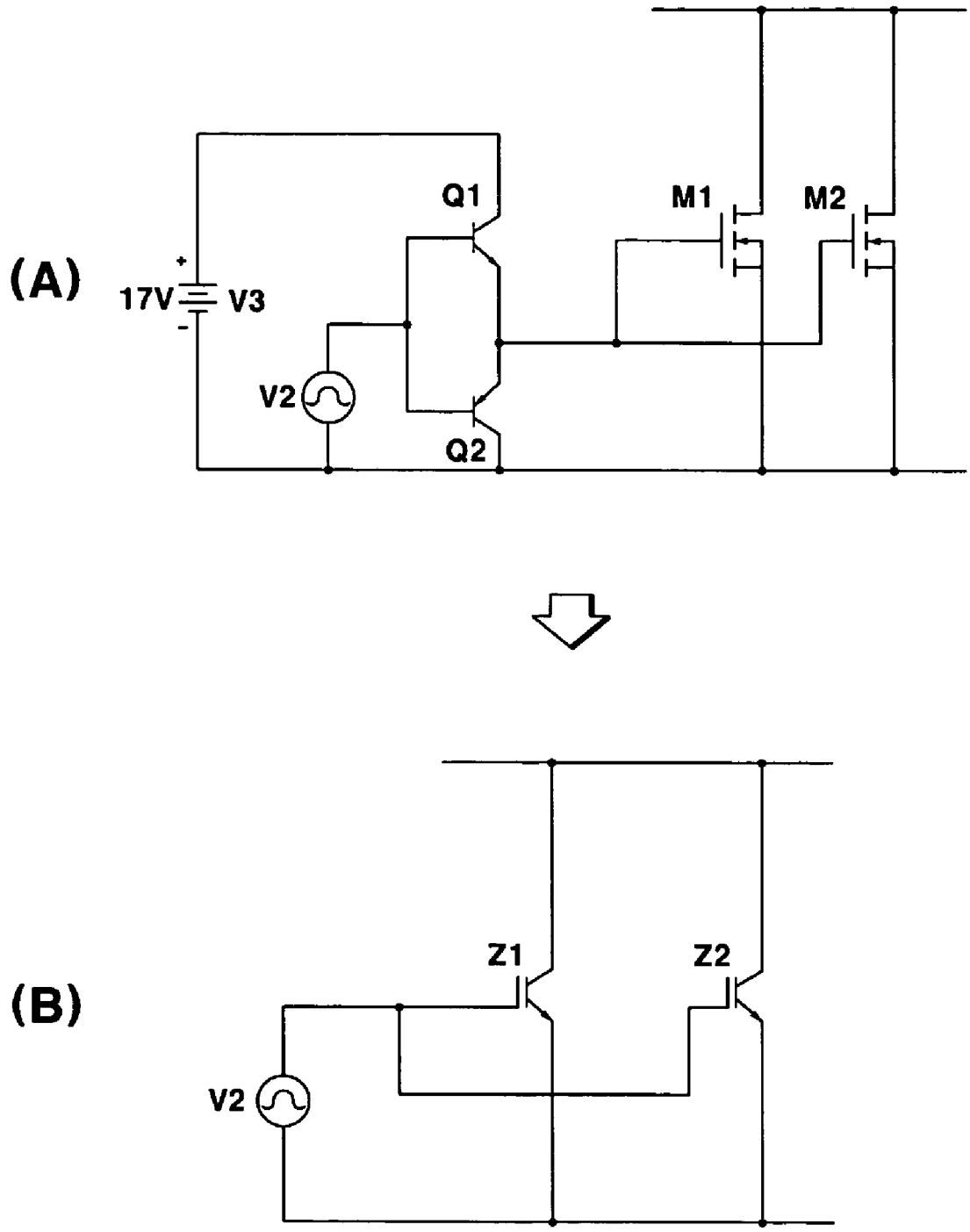
FIG. 10 shows a driving circuit that may be eliminated when IGBTs are coupled in parallel according to the first exemplary embodiment of the present invention.

FIG. 10B shows a diagram of the switching device, without the diode D1, when IGBTs Z1 and Z2 are coupled in parallel according to the first exemplary embodiment of the present invention. This configuration may allow elimination of a circuit for driving the switching device.

FIG. 10A shows a diagram for representing a push-pull gate driving circuit that may be used as a driving circuit with the conventional switch having MOSFETs M1 and M2 coupled in parallel. A power V2 represents a gate driving power, and a power 17V represents a bias power of transistors Q1 and Q2 in the push-pull gate driving circuit. The push-pull gate driving circuit may be necessary for driving the switching device formed with the MOSFETs M1 and M2 coupled in parallel. However, as shown in FIG. 10B, the switching device according to an exemplary embodiment of the present invention may be turned on and off without a push-pull gate driving circuit. The IGBT is formed with a structure in which a gate is insulated and divided in the likely manner of the MOSFET, and charges accumulate to the gate electrode when the gate driving voltage V2 is applied. However, the quantity of charges Qq to be charged to the gate electrode may be less than that of the MOSFET because the size of the semiconductor chip of the IGBT may be smaller than the MOSFET. Accordingly, the switching operations of the IGBTs Z1 and Z2 may be performed by using the gate driving power V2, without using the push-pull driving circuit, because of the reduced quantity of charges Qq that may be needed.

It is preferable that the switching devices shown in FIG. 4 and FIG. 7 are used for applying the sustain voltage to the panel capacitor of the PDP because the switching operation is performed most frequently in the sustain period where a lot of power is consumed. The sustain voltage represents a difference between a voltage applied to sustain electrodes $X_1$-$X_n$ and a voltage applied to scan electrodes $Y_1$-$Y_n$, and it may correspond to a voltage for discharging the selected cells in the sustain period.

Figure 11A:
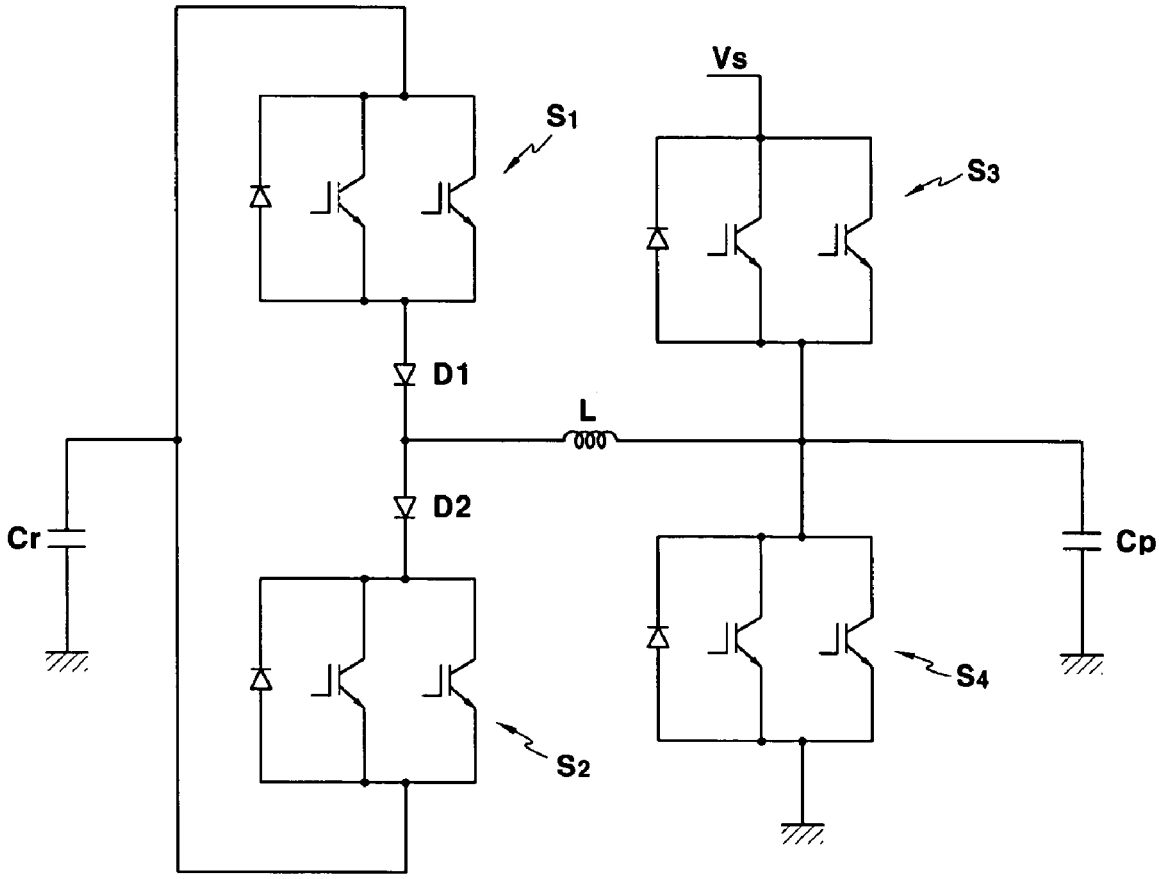
FIG. 11A and FIG. 11B are diagrams for representing a driving apparatus of a PDP according to the first and second exemplary embodiments of present invention.
Figure 11B:
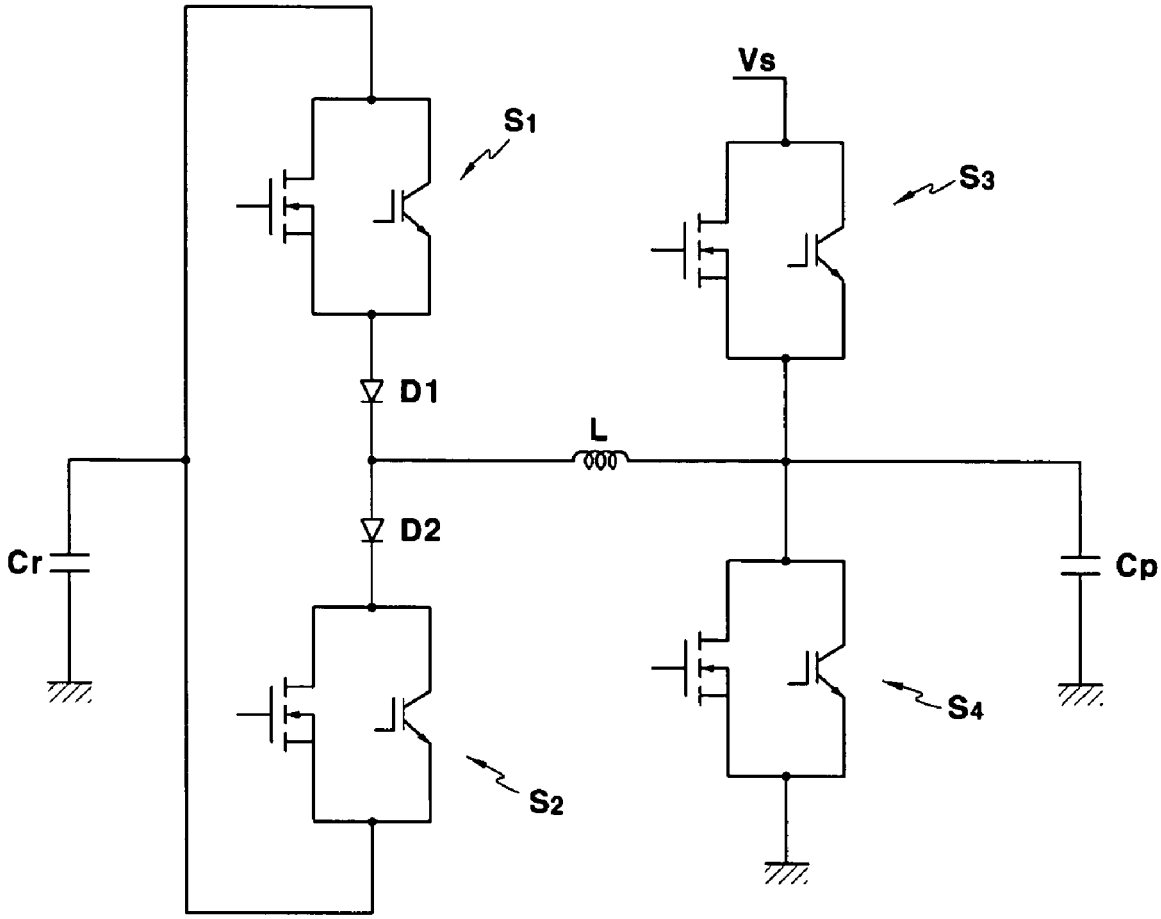

FIG. 11A and FIG. 11B show a driving apparatus of the PDP used for applying the sustain voltage $V_s$ according to exemplary embodiments of the present invention.

As shown in FIG. 11A and FIG. 11B, the driving apparatus of the PDP comprises a capacitor $C_r$ for power recovery, switches $S_1$, $S_2$, $S_3$, and $S_4$, an inductor L, a panel capacitor $C_p$, and diodes $D_1$ and $D_2$. The capacitor $C_r$ is charged with a voltage of $V_s/2$. The switches $S_1$, $S_2$, $S_3$, and $S_4$ are formed with a plurality of the IGBTs coupled in parallel or the IGBTs and MOSFETs coupled in parallel, as shown in the first and second exemplary embodiments of the present invention. A terminal of the panel capacitor $C_p$ may correspond to a scan electrode or a sustain electrode. When a terminal of the panel capacitor Cp corresponds to the scan electrode, the other terminal (represented as 0V) corresponds to the sustain electrode and vice versa. A voltage corresponding to a voltage of both terminals of the panel capacitor Cp for discharging the selected cells in the sustain period is applied to another terminal of the panel capacitor Cp to which the sustain voltage Vs is applied. In other words, during a sustain period, the sustain voltage $V_s$ may be alternately applied to the sustain electrodes and the scan electrodes. In FIGS. 11A and 11B, the sustain voltage $V_s$ is assumed to be a ground voltage 0V for convenience.

The switch $S_1$ increases the voltage of the terminal of the panel capacitor $C_p$ near to the voltage of $V_s$ by using a LC resonance, and the switch $S_3$ clamps the voltage of the terminal of the panel capacitor $C_p$ to the voltage of $V_s$. The switch $S_2$ decreases the voltage of the terminal of the panel capacitor $C_p$ near to the voltage of 0V by using the LC resonance, and the switch $S_4$ clamps the voltage of the terminal of the panel capacitor $C_p$ to the voltage of 0V. The diodes $D_1$ and $D_2$ intercept a reverse current when the panel capacitor $C_p$ is LC-charged/discharged. The driving apparatus of the PDP for performing the energy recovery operation is represented in FIG. 11A and FIG. 11B. However, the sustain voltage $V_s$ is properly applied in the sustain period by using the switches $S_3$ and $S_4$ without using any others.

A conventional method for driving the PDP comprises the reset period, the address period, and the sustain period. The circuit described in FIG. 11A and FIG. 11B may be used for sustain-discharging the discharge cells in the sustain period, which may solve problems caused by heat generation and withstand voltage due to the large number of required switching operations of the switches $S_1$, $S_2$, $S_3$, and $S_4$. The circuit may increase the PDP's efficiency when the PDP has an increased pressure of Xe gas requiring higher driving voltages.

The switching device of exemplary embodiments of the present invention may also be used for the switching device in a circuit applying an address voltage $V_a$ in the address period. The address voltage $V_a$ represents a voltage that is applied to the address electrode for selecting the discharge cells. The circuit for applying the address voltage $V_a$ may be the same circuit as shown in FIG. 11A and FIG. 11B except that the address voltage $V_a$ is substituted for the sustain voltage $V_s$, and the terminal of the panel capacitor $C_p$ may correspond to the address electrode. The problems of heat generation and the withstand voltage may also occur in the address period because of the large number of switching operations required for applying the address voltage $V_a$. Therefore, it may be more effective to use the switching device of the first and the second exemplary embodiments of the present invention when the partial pressure of Xe gas is increased, which requires an increased driving voltage.

As above described, the PDP's efficiency may be increased when the switching device for the PDP is formed with more than one IGBT coupled in parallel. The cost may be reduced because the size of the semiconductor may be reduced. When an IGBT and a MOSFET are coupled in parallel, the MOSFET may be used for the switching device in the low current area, and the IGBT may be used for the switching device in the high current area. This may prevent current from concentrating on one side when 2 IGBTs are used and it may increase efficiency.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A switching device for driving a plasma display panel having a plurality of address electrodes, a plurality of scan electrodes and a plurality of sustain electrodes arranged in pairs, and panel capacitors formed between the plurality of address electrodes, and between the plurality of scan electrodes and the plurality of sustain electrodes, the switching device comprising:

a first insulated gate bipolar transistor for performing turning on or turning off operations by a voltage applied to a gate of the first insulated gate bipolar transistor; and a second insulated gate bipolar transistor, coupled in parallel to the first insulated gate bipolar transistor, for performing the turning on or turning off operations by a voltage applied to a gate of the second insulated gate bipolar transistor, wherein the first insulated gate bipolar transistor and the second insulated gate bipolar transistor are disposed on a current path between a power source and an electrode of a panel capacitor.

2. The device of claim 1, wherein the switching device for the PDP supplies a sustain voltage to the panel capacitors.

3. The device of claim 1, wherein the switching device for the PDP supplies an address voltage to the panel capacitors.

4. The device of claim 1, further comprising:

a plurality of insulated gate bipolar transistors coupled in parallel to the first insulated gate bipolar transistor and the second insulated gate bipolar transistor.

5. The device of claim 1, further comprising:

a diode coupled in parallel to the first insulated gate bipolar transistor and the second insulated gate bipolar transistor, wherein the diode flows a reverse current generated when the PDP is driven.

6. The device of claim 2, further comprising:

a first sensor for measuring a collector current of the first insulated gate bipolar transistor;

a first compensator for controlling a voltage applied to the gate of the first insulated gate bipolar transistor according to the collector current measured by the first sensor;

a second sensor for measuring a collector current of the second insulated gate bipolar transistor; and a second compensator for controlling a voltage applied to the gate of the second insulated gate bipolar transistor according to the collector current measured by the second sensor.

7. A switching device for driving a plasma display panel (PDP) having a plurality of address electrodes, a plurality of scan electrodes and a plurality of sustain electrodes arranged in pairs, and panel capacitors formed between the plurality of address electrodes, and between the plurality of scan electrodes and the plurality of sustain electrodes, the switching device comprising:

a first metal-oxide semiconductor field effect transistor for performing turning on or turning off operations by a voltage applied to a gate of the first metal-oxide semiconductor field effect transistor; and a first insulated gate bipolar transistor, coupled in parallel to the first metal-oxide semiconductor field effect transistor, for performing the turning on or turning off operations by a voltage applied to a gate of the first insulated gate bipolar transistor.

8. The device of claim 7, wherein the switching device for the PDP supplies a sustain voltage to the panel capacitors.

9. The device of claim 7, wherein the switching device for the PDP supplies an address voltage to the panel capacitors.

10. The device of claim 7, further comprising a plurality of insulated gate bipolar transistors coupled in parallel to the first metal-oxide semiconductor field effect transistor and the first insulated gate bipolar transistor.

11. The device of claim 10, further comprising a plurality of metal-oxide semiconductor field effect transistors coupled in parallel to the first metal-oxide semiconductor field effect transistor and the first insulated gate bipolar transistor.

12. The device of claim 7, wherein the first metal-oxide semiconductor field effect transistor operates in a first current area to allow a first current to flow when the PDP operates, and wherein the first insulated gate bipolar transistor operates in a second current area which is greater than the first current area to allow a second current to flow when the PDP operates.

13. An apparatus for driving a plasma display panel in which a discharge space is formed by a plurality of first electrodes and a plurality of second electrodes, comprising:

a first switch coupled between the plurality of first electrodes and a first power that supplies a first voltage; and a second switch coupled between the plurality of first electrodes and a second power that supplies a second voltage, wherein the first switch and the second switch each comprise at least two insulated gate bipolar transistors, the at least two insulated gate bipolar transistors being coupled in parallel to each other, and wherein the first voltage applies a sustain voltage, which is a voltage difference between the first voltage and the second voltage, in a sustain period.

14. The apparatus of claim 13, wherein the plasma display panel further comprises a plurality of third electrodes formed orthogonal to the plurality of first electrodes and the plurality of second electrodes, the apparatus further comprising:

a third switch coupled between the plurality of third electrodes and a third power that supplies a third voltage, wherein the third switch comprises at least two insulated gate bipolar transistors coupled in parallel, and the third voltage applies an address voltage to the plurality of third electrodes in an address period.

15. An apparatus for driving a plasma display panel in which a discharge space is formed by a plurality of first electrodes and a plurality of second electrodes, comprising:

a first switch coupled between the plurality of first electrodes and a first power that supplies a first voltage;

a second switch coupled between the plurality of first electrodes and a second power that supplies a second voltage, wherein the first switch and the second switch comprise a metal-oxide semiconductor field effect transistor and an insulated gate bipolar transistor coupled in parallel; and wherein the first voltage applies a sustain voltage, which is a voltage difference between the first voltage and the second voltage, in a sustain period.

16. The apparatus of claim 15, wherein the plasma display panel further comprises a plurality of third electrodes formed orthogonal to the plurality of first electrodes and the plurality of second electrodes, the apparatus further comprising:

a third switch coupled between the plurality of third electrodes and a third power that supplies a third voltage, wherein the third switch comprises a metal-oxide semiconductor field effect transistor and an insulated gate bipolar transistor coupled in parallel, and wherein the third voltage applies an address voltage to the plurality of third electrodes in an address period.

* * * * *